US011813664B2

(12) United States Patent
Larsen et al.

(10) Patent No.: US 11,813,664 B2
(45) Date of Patent: Nov. 14, 2023

(54) SAND MOULD IDENTIFICATION DEVICE

(71) Applicant: DISA Industries A/S, Taastrup (DK)

(72) Inventors: Per Larsen, Søborg (DK); Henrik Wegge, Sorø (DK)

(73) Assignee: DISA Industries A/S, Taastrup (DK)

( * ) Notice: Subject to any disclaimer, the term of this patent is extended or adjusted under 35 U.S.C. 154(b) by 87 days.

(21) Appl. No.: 17/610,001

(22) PCT Filed: Apr. 27, 2020

(86) PCT No.: PCT/EP2020/061612
§ 371 (c)(1),
(2) Date: Nov. 9, 2021

(87) PCT Pub. No.: WO2020/229146
PCT Pub. Date: Nov. 19, 2020

(65) Prior Publication Data

US 2022/0193755 A1 Jun. 23, 2022

(30) Foreign Application Priority Data

May 10, 2019 (EP) ..... 19173871

(51) Int. Cl.
*B22C 7/00* (2006.01)
*B22C 7/04* (2006.01)
*B22C 23/00* (2006.01)

(52) U.S. Cl.
CPC ..... *B22C 7/005* (2013.01); *B22C 7/04* (2013.01); *B22C 23/00* (2013.01)

(58) Field of Classification Search
CPC .. B22C 7/00; B22C 7/005; B22C 7/04; B22C 23/00; B29C 33/428
(Continued)

(56) References Cited

U.S. PATENT DOCUMENTS 4,137,962 A 2/1979 Pol
7,252,136 B2 8/2007 Rieke
(Continued)

FOREIGN PATENT DOCUMENTS

DE 195 02 564 A1 8/1996
DE 10 2005 061 608 A1 7/2006
(Continued)

OTHER PUBLICATIONS

"Allzeit Die Richtige Zeit", Plastverarbeiter, Huethig GMBH, Heidelberg, DE, vol. 49, No. 3, Mar. 1, 1998, p. 94/95, XP-000767116, ISSN: 0032-1338.
(Continued)

*Primary Examiner* — Kevin P Kerns
(74) *Attorney, Agent, or Firm* — Birch, Stewart, Kolasch & Birch, LLP

(57) ABSTRACT

The sand mould identification device has a housing with an identification pattern face adapted to be arranged in a pattern forming surface of a sand moulding machine. Individually adjustable indicator elements in the identification pattern face are adjustable by means of an actuator. The housing includes an insertion portion adapted to be inserted into a corresponding recess of said sand moulding machine. The identification pattern face is located at a front end of the insertion portion. The insertion portion is adapted to be inserted into the sand moulding machine in an insertion direction extending from a rear end to the front end of the insertion portion. A mounting bracket is accessible at or behind the rear end of the insertion portion for mounting or demounting the housing to or from the sand moulding machine or core shooter.

20 Claims, 12 Drawing Sheets

(58) Field of Classification Search
USPC ..... 164/6, 45, 159, 169, 207, 228, 229, 235, 164/239
See application file for complete search history.

(56) References Cited

U.S. PATENT DOCUMENTS

| | | | |
|---|---|---|---|
| 7,637,473 | B2 | 12/2009 | Yang |
| 2002/0059874 | A1 | 5/2002 | Schuurman et al. |

FOREIGN PATENT DOCUMENTS

| | | | |
|---|---|---|---|
| DE | 10 2015 215 318 | A1 | 2/2017 |
| WO | WO 2017/025266 | A1 | 2/2017 |

OTHER PUBLICATIONS

International Search Report for PCT/EP2020/061612 dated Jul. 21, 2020.
Plastverarbeiter, Huethig GMBH, Heidelberg, DE, vol. 56, No. 9, Sep. 1, 2005, p. 125, XP001207559, ISSN: 0032-1338.
Search Report issued in European priority application 19173871.5 dated Nov. 14, 2019.
Written Opinion of the International Searching Authority for PCT/EP2020/061612 (PCT/ISA/237) dated Jul. 21, 2020.

SAND MOULD IDENTIFICATION DEVICE

BACKGROUND OF THE INVENTION

The present invention relates to a sand mould identification device with a housing including an identification pattern face adapted to be arranged in a pattern forming surface of a sand moulding machine or a core shooter, wherein a plurality of individually adjustable indicator elements are arranged rotationally in the identification pattern face, the rotational position of each individual indicator element being adjustable by means of an actuator, wherein the housing includes an insertion portion adapted to be inserted into a corresponding recess of said sand moulding machine or core shooter and having a front end and a rear end, wherein the identification pattern face is located at the front end of the insertion portion, wherein at least a part of each actuator is inserted into the insertion portion, and wherein the housing includes a mounting device for mounting the housing to the sand moulding machine or core shooter.

WO 2017/025266 A1 discloses a sand mould identification device comprising a housing, which has a mould forming surface, in which a plurality of individually adjustable indicator elements are arranged, each of which being surrounded by a frame element, wherein each indicator is connected with a respective actuator arranged in the housing, the actuators being operatively connected to an electronic control for individual adjustment of the indicator elements. Each individually adjustable indicator element has a symmetrical needle form and may be positioned in four different recognisable positions. The illustrated embodiment has six indicator elements resulting in 4,096 different possible combinations. The mould forming surface is arranged on a cover plate protruding around the housing and thereby forming a mounting flange adapted to abut a pattern of a pattern plate in a sand moulding machine. The mounting flange is provided with holes for mounting screws. However, it is a disadvantage that this device is rather bulky and has a large footprint in the sand mould pattern. As a consequence, the device is not suitable for smaller castings or castings having many details on the surface. Furthermore, in a modern foundry production line producing up to about 5000 castings per hour, in order to obtain suitable traceability of the produced castings for retrieval of related production and quality data, many more different combinations of the indicator elements are required than what is possible with this device.

U.S. Pat. No. 4,137,962 discloses a casting-marking apparatus adapted for incorporation in a permanent foundry pattern of the type used to produce sand moulds for metal casting. The apparatus carries a marking that is impressed in the sand mould and subsequently reproduced on a casting. The apparatus is designed and constructed so that the marking that it carries can be altered from a station remote from the pattern. In the apparatus, the alterable marking is carried out by a marking body that is rotated by an air actuated piston. However, this apparatus is adjustable for only 12 different identification marks to be produced by the marking body. As explained above, in a modern foundry production line, many more different combinations are required than what is possible with this device. Although more different combinations could be achieved by providing more marking bodies, the illustrated embodiment having one marking body is already too bulky for most commonly occurring castings. U.S. Pat. No. 7,252,136 B2 discloses a similar device.

US 2002/0059874 A1 discloses an automated date insert that imprints the date on a moulded product. The automatic date insert includes a front face with attached indicators that mark a date pattern onto the surface of the moulded product. Each indicator is operatively connected to an indicating means that imprints a date on the moulded product that corresponds to the date pattern of the indicator. The indicating means is operatively connected to an electric motor that is activated and controlled by a processing means such that the electric motor causes the indicator means to move a pre-selected amount corresponding to a pre-determined time or date interval transmitted by the processing means. However, this device is rather bulky even though the number of different combinations that may be achieved are not enough for a modern foundry production line.

In a modern foundry production line, foundry quality costs may indeed be very high. For instance, in the production of demanding automotive products, the combined quality costs related to the rejection of defective castings at foundry and user of the castings may be up to 10 percent of the total production costs. When castings are rejected due to quality issues, many consequential costs may be incurred. The possible causes for rejection must be analysed and production may have to be adapted accordingly, whereby production may be delayed. However, with prior art casting-marking solutions, it has not been possible to link bad quality for individual castings with relevant process parameters. Rather, it has only been possible to link batch-based quality data like percentage of castings defective due to sand inclusions, percentage of castings defective due to porosities, etc. with batch-based process parameters. As a consequence, it has proven very difficult to further reduce quality costs.

SUMMARY OF THE INVENTION

The object of the present invention is to provide a compact sand mould identification device suitable for providing a large number of different combinations of the indicator elements.

In view of this object, in the assembled state of the sand mould identification device, the insertion portion is adapted to be inserted into the sand moulding machine or core shooter in an insertion direction extending from the rear end to the front end of the insertion portion, the mounting device is accessible at or behind the rear end of the insertion portion for mounting or demounting the housing to or from the sand moulding machine or core shooter, and the mounting device has the form of a mounting bracket arranged at or behind the rear end of the insertion portion and protruding in relation to the insertion portion in a direction being transverse to the insertion direction.

In this way, by adapting the insertion portion to be inserted into the sand moulding machine or core shooter from a rear side of the pattern forming surface, and by arranging the mounting device in the form of the mounting bracket to be accessible at or behind the rear end of the insertion portion, a very little footprint of the sand mould identification device in the pattern forming surface may be achieved while at the same time a suitable number of individually adjustable indicator elements may be arranged rotationally in the identification pattern face. Thereby, a large number of different combinations of the indicator elements may be achieved.

In an embodiment, a motor control for the actuators and a network adaptor is arranged behind the rear end of the insertion portion. Thereby, a motor control and a network adaptor may be arranged in the housing while the insertion portion may still have a compact configuration.

In a structurally particularly advantageous embodiment, the insertion portion forms part of a mounting block forming protrusions extending in opposed directions at the rear end of the insertion portion, and the mounting bracket is fastened to the respective protrusions preferably by means of bolts.

In a structurally particularly advantageous embodiment, the actuators are arranged along a central line of the mounting block extending between the protrusions of the mounting block, the mounting bracket forms opposed mounting flanges at either side of the central line of the mounting block, and the mounting flanges are adapted to be mounted on the sand moulding machine or core shooter preferably by means of bolts. Thereby, a slim insertion portion may be achieved resulting in that the sand mould identification device may have a small footprint in the pattern forming surface.

In an embodiment, the mounting bracket includes a first bracket part and a second bracket part clamped together and gripping on either side of a part of each actuator. Thereby, by using the mounting bracket as a fixture for the actuators, an even more compact device may be achieved.

In an embodiment, an elastic element is sandwiched between the actuators and the first and second bracket parts. Thereby, the actuators may be even better secured in the housing.

In a structurally particularly advantageous embodiment, a printed circuit board including the motor control and the network adaptor abuts the first and second bracket parts oppositely the insertion portion. Thereby, an even more compact device may be achieved.

In a structurally particularly advantageous embodiment, a rear end of an electric motor of each actuator extends through a hole in the printed circuit board. Thereby, an even more compact device may be achieved. The total dimensions of the housing may be very small in relation to the dimensions of the actuators.

In an embodiment, the printed circuit board is partly covered by a cover so that an edge of the printed circuit board extends from the cover and is provided with at least one network connector part. Thereby, the printed circuit board may be covered and at the same time, a compact device may be achieved.

In a structurally particularly advantageous embodiment, each individually adjustable indicator element is arranged at a front end of a cylindrical part fitting in a corresponding bore of the insertion portion, a rear end of the cylindrical part engages a shaft end of the corresponding actuator, and the cylindrical part and/or the corresponding bore has a recess in which a sealing ring is arranged. The sealing ring may prevent sand and dust from reaching the internal of the housing.

In an embodiment, a first end stop protrusion is arranged on the cylindrical part, and a second corresponding end stop protrusion is arranged in the corresponding bore of the insertion portion. Thereby, the motor control may reset the starting position of the actuators when the first and second end stop protrusions abut each other, and consequently a more accurate control of the individually adjustable indicator elements may be achieved.

In an embodiment, the sealing ring is arranged between the front end of the cylindrical part and the first end stop protrusion arranged on the cylindrical part.

Thereby, the sealing ring may prevent sand and dust from reaching the first and second end stop protrusions and thereby negatively influencing the resetting of the starting position of the actuators.

In an embodiment, the rear end of the cylindrical part is provided with a partly cylindrical hole having an axially extending flat face corresponding to an axially extending flat face of the shaft end of the corresponding actuator, and said shaft end engages the partly cylindrical hole. Thereby, a very precise connection between the rear end of the cylindrical part and the shaft end of the actuator is possible even for very small dimension of the cylindrical part and the shaft end, such as a general diameter in the order of for instance 0.75 mm, 1.5 mm or 2 mm.

In an embodiment, the network adaptor of the sand mould identification device is adapted to be connected to a controller of a sand moulding machine by means of a connector including a first connector part adapted to be arranged on a pattern plate of the sand moulding machine and a second connector part adapted to be arranged on the sand moulding machine, each connector part includes a number of electrical contact elements, and the electrical contact elements of the second connector part are adapted to flexibly engage and slide on a top side of the respective electrical contact elements of the first connector part during a mounting operation of the pattern plate on the sand moulding machine. Thereby, a stable, cabled connection to the controller may be provided without risk that sand and dust build up on the contact surfaces of the contact elements of the first and second connector part. Because the electrical contact elements of the second connector part are adapted to flexibly engage and slide on a top side of the respective electrical contact elements of the first connector part during a mounting operation, any sand or dust left on the contact surfaces will be removed by the sliding action at each mounting operation.

In an embodiment, the insertion portion has a cross-sectional dimension transversely to the insertion direction being maximum 30 percent, preferably maximum 20 percent, and most preferred maximum 10 percent larger than a diameter of the part of the actuator inserted into the insertion portion. Thereby, an even more compact device may be achieved.

The present invention further relates to a sand moulding machine including at least one sand mould identification device as described above.

BRIEF DESCRIPTION OF THE DRAWINGS

The invention will now be explained in more detail below by means of examples of embodiments with reference to the very schematic drawing, in which.

DETAILED DESCRIPTION OF THE INVENTION

Figure 1:
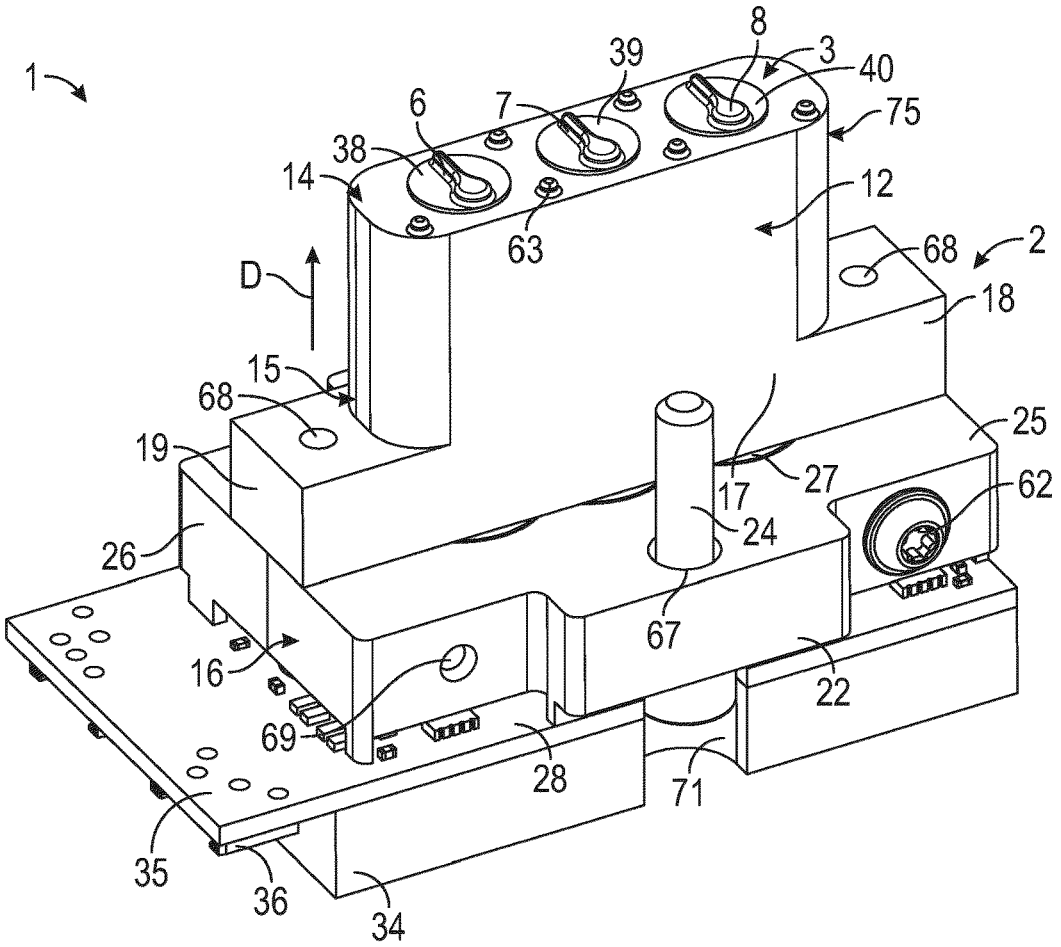
FIG. 1 is a perspective view seen obliquely from a front side of a sand mould identification device according to the present invention.
Figure 5:
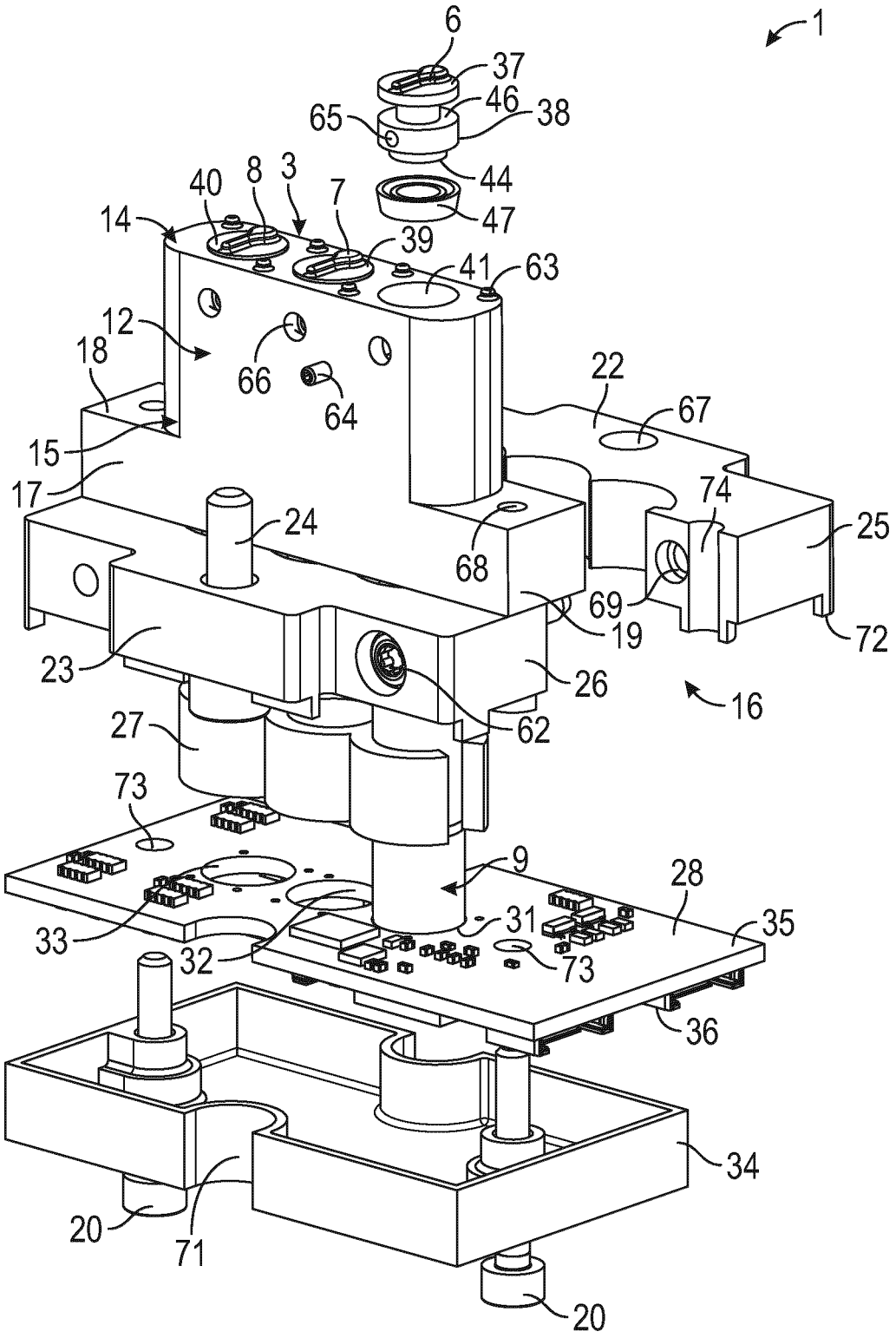
FIG. 5 is a perspective exploded view seen obliquely from the front side of the sand mould identification device of FIG. 1.
Figure 10:
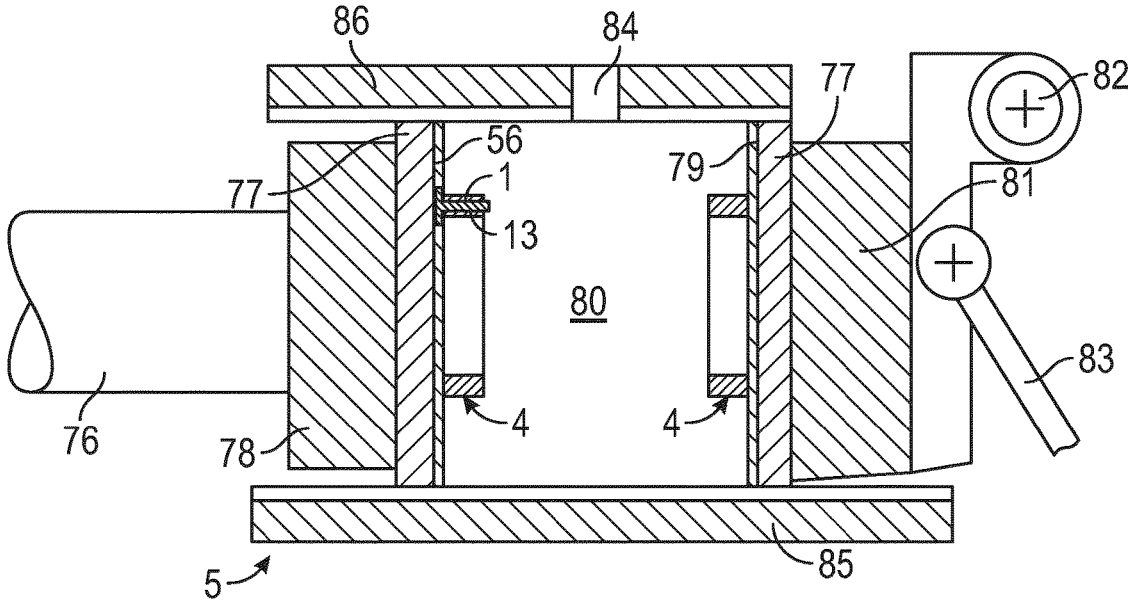
FIG. 10 is a longitudinal cross-section through a vertical sand moulding machine including the sand mould identification device of FIG. 1.
Figure 12:
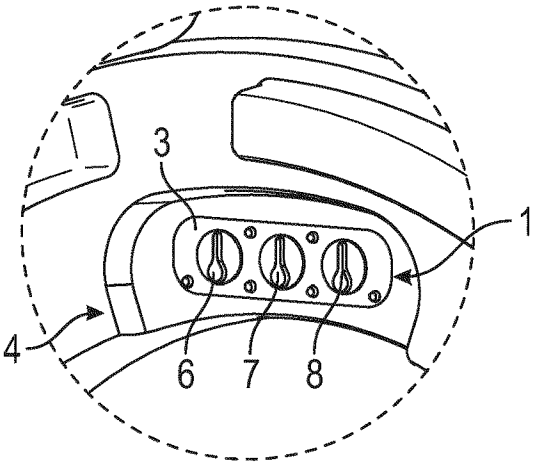
FIG. 12 illustrates a detail of FIG. 11 on a larger scale.
Figure 11:
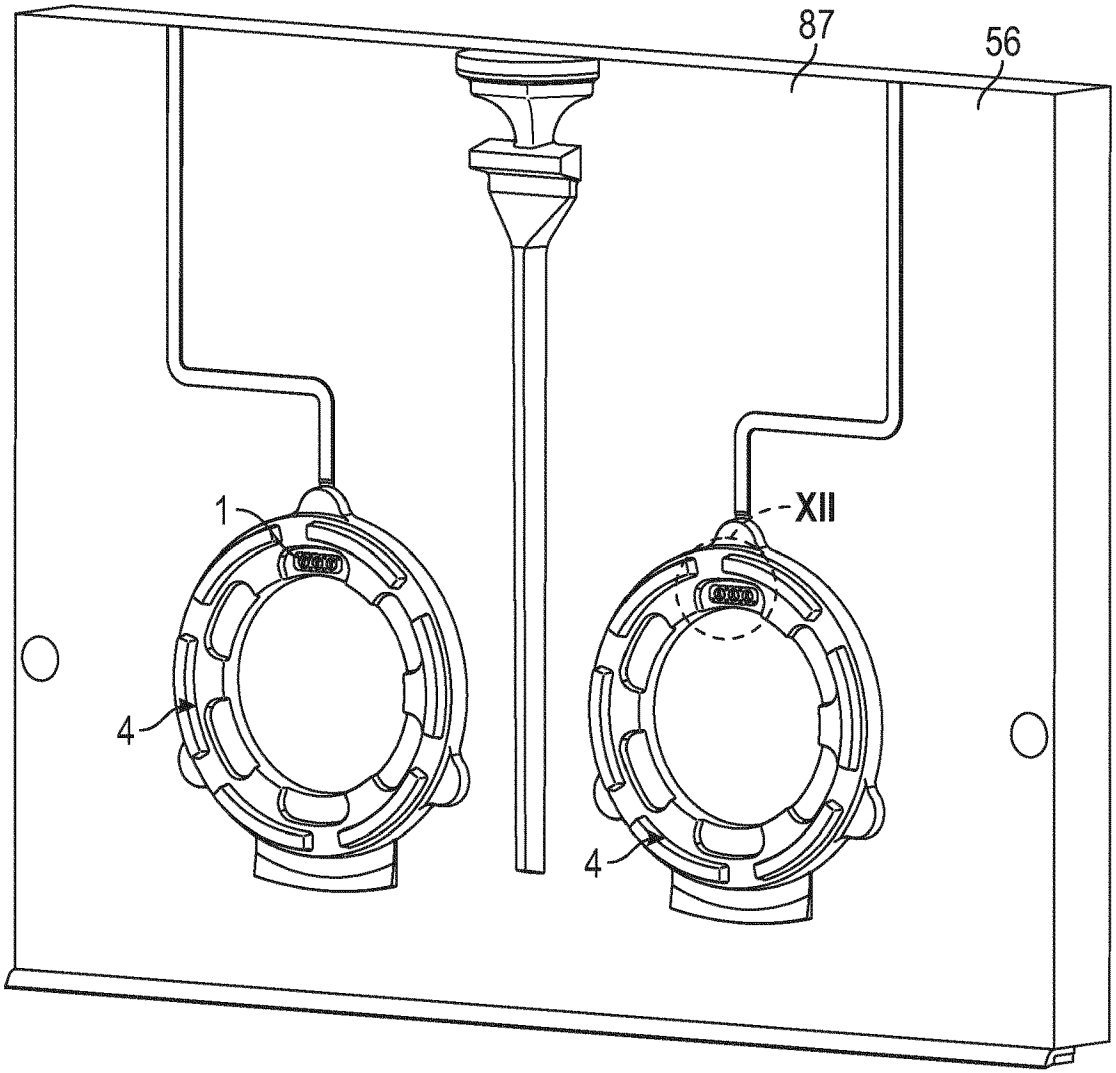
FIG. 11 is a perspective view of a front side of a pattern plate for a vertical sand moulding machine including two sand mould identification devices as illustrated in FIG. 1.
Figure 14:
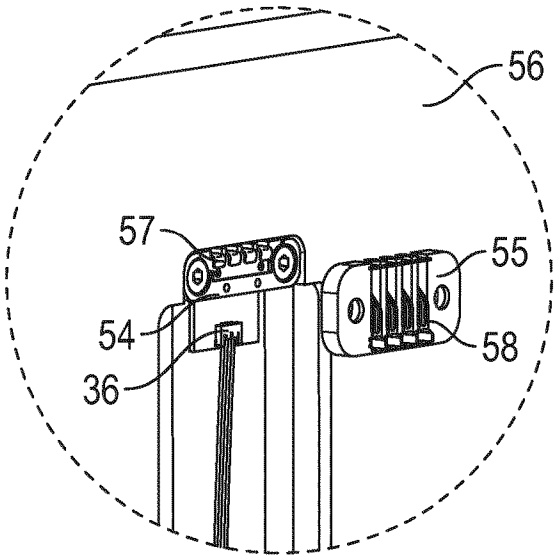
FIG. 14 illustrates a first detail of FIG. 13 on a larger scale.
Figure 15:
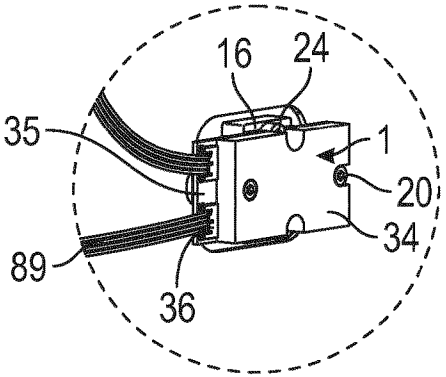
FIG. 15 illustrates a second detail of FIG. 13 on a larger scale.
Figure 13:
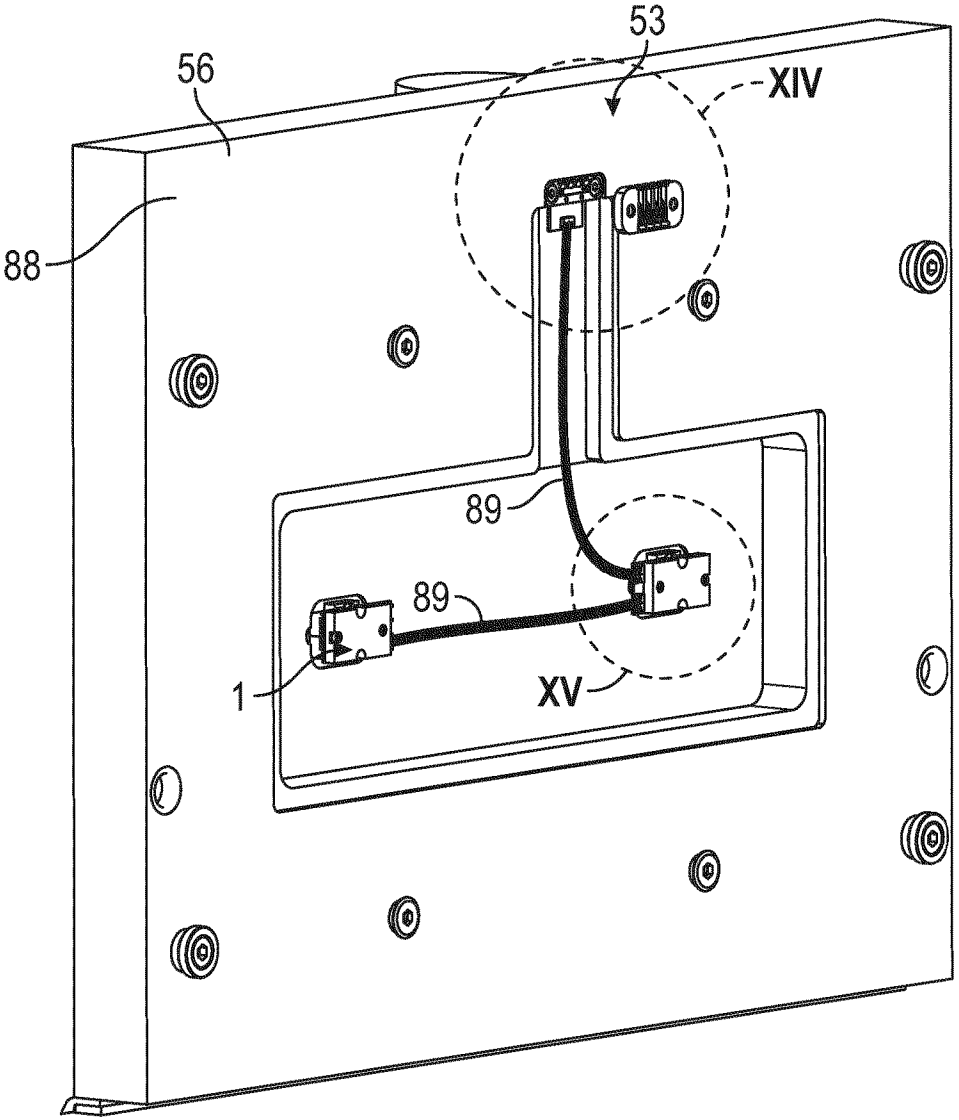
FIG. 13 is a perspective view of a back side of the pattern plate of FIG. 11.
Figure 17:
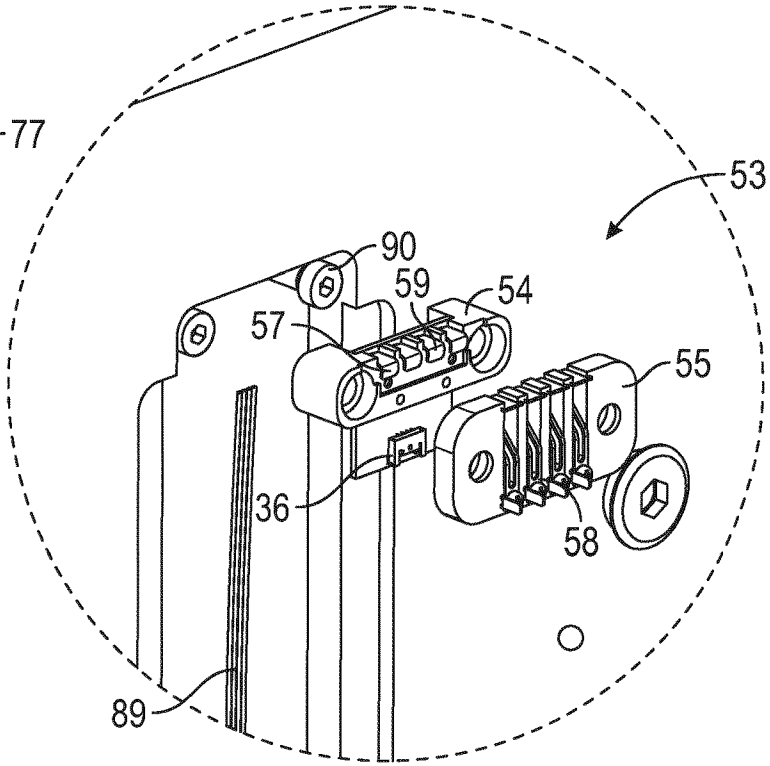
FIG. 17 illustrates a detail of FIG. 16 on a larger scale.

FIG. 1 shows a sand mould identification device 1 with a housing 2 including an identification pattern face 3 adapted to be arranged in a pattern forming surface 4 of a sand moulding machine 5 as illustrated in FIGS. 10 to 15. Alternatively, the identification pattern face 3 may be arranged in a pattern forming surface of a not shown core shooter. The identification pattern face 3 is adapted to impress or imprint an individual identification pattern in a sand mould or a core for a sand mould. Said individual identification pattern may subsequently be reproduced in a metal casting. Three individually adjustable indicator elements 6, 7, 8 are arranged rotationally in the identification pattern face 3, and the rotational position of each individual indicator element 6, 7, 8 is adjustable by means of an actuator 9, 10, 11 as seen for instance in FIGS. 5, 6 and 7. The housing 2 includes an insertion portion 12 adapted to be inserted into a corresponding recess 13 of the sand moulding machine 5 as seen in FIG. 10 or of a not shown core shooter. The insertion portion 12 has a front end 14 and a rear end 15, wherein the identification pattern face 3 is located at the front end 14 of the insertion portion 12. A part of each actuator 9, 10, 11 is inserted into the insertion portion 12, and the housing 2 includes a mounting device in the form of a mounting bracket 16 for mounting the housing 2 to the sand moulding machine 5 or core shooter.

In the assembled state of the sand mould identification device 1 as seen in FIG. 1, the insertion portion 12 is adapted to be inserted into the sand moulding machine or core shooter in an insertion direction D extending from the rear end 15 to the front end 14 of the insertion portion 12. In other words, the assembled sand mould identification device 1 is adapted to be mounted in the sand moulding machine 5 or core shooter by inserting the insertion portion 12 into the corresponding recess 13 of the sand moulding machine 5 or core shooter by displacement of the sand mould identification device 1 in the direction of the arrow indicating the insertion direction D in FIG. 1. As it will be understood, thereby the insertion portion 12 is inserted into the sand moulding machine 5 or core shooter from a rear side of the pattern forming surface 4. In the illustrated embodiment, the mounting device in the form of the mounting bracket 16 is arranged at or behind the rear end 15 of the insertion portion 12 and protrudes in relation to the insertion portion 12 in a direction being transverse to the insertion direction D. Alternatively, according to the present invention, the mounting device may simply be accessible at or behind the rear end 15 of the insertion portion 12 for mounting or demounting the housing 2 to or from the sand moulding machine 5 or core shooter. For instance, the mounting device may have the form of one or more wedges arranged in walls of the insertion portion 12 so that the wedges may be displaced to press against walls of the corresponding recess 13 of the sand moulding machine 5 or core shooter when the insertion portion 12 is inserted into said recess 13. For instance, such wedges may be caused to slide along the insertion direction D in corresponding grooves of walls of the insertion portion 12 by rotation of screws having screw heads accessible from the rear end 15 of the insertion portion 12. The groove of the wall of the insertion portion 12 may extend in the insertion direction D and have a bottom which is inclined in relation to the insertion direction, thereby causing the wedge to move in a direction out of the groove when the wedge is displaced along the groove. However, the skilled person will understand that many other embodiments of mounting devices may be adapted be accessible at or behind the rear end 15 of the insertion portion 12 for mounting or demounting the housing 2 to or from the sand moulding machine 5 or core shooter. For instance, at snap lock type mounting device may be arranged to lock the insertion portion 12 in the recess 13 of the sand moulding machine 5 or core shooter when the insertion portion 12 is inserted into said recess 13. In order to demount the insertion portion 12 from the recess 13, a button of the snap lock type mounting device arranged at or behind the rear end 15 of the insertion portion 12 may be adapted to be pressed. In this way, the mounting device does not take up any space at the front end 14 of the insertion portion 12 where the identification pattern face 3 is located.

Thereby, a very little footprint of the sand mould identification device 1 in the pattern forming surface 4 may be achieved while at the same time a suitable number of individually adjustable indicator elements 6, 7, 8 may be arranged rotationally in the identification pattern face 3. Thereby, a large number of different combinations of the indicator elements may be achieved.

Figure 2:
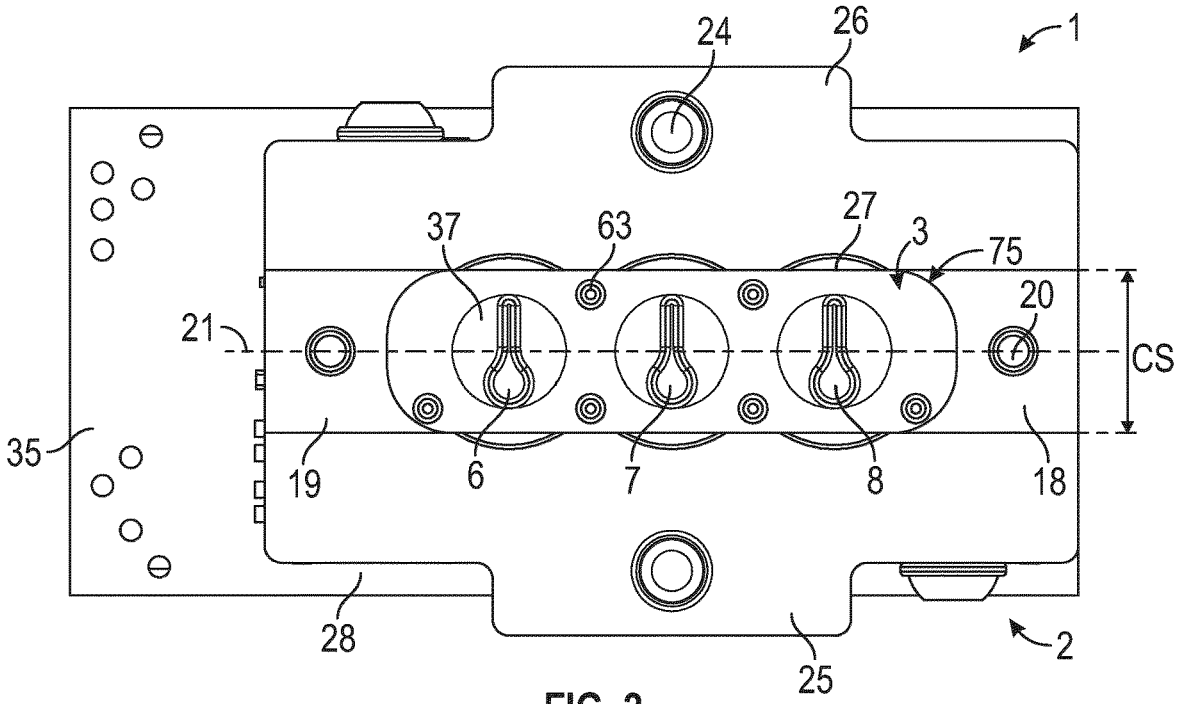
FIG. 2 is a front view of the sand mould identification device of FIG. 1.
Figure 7:
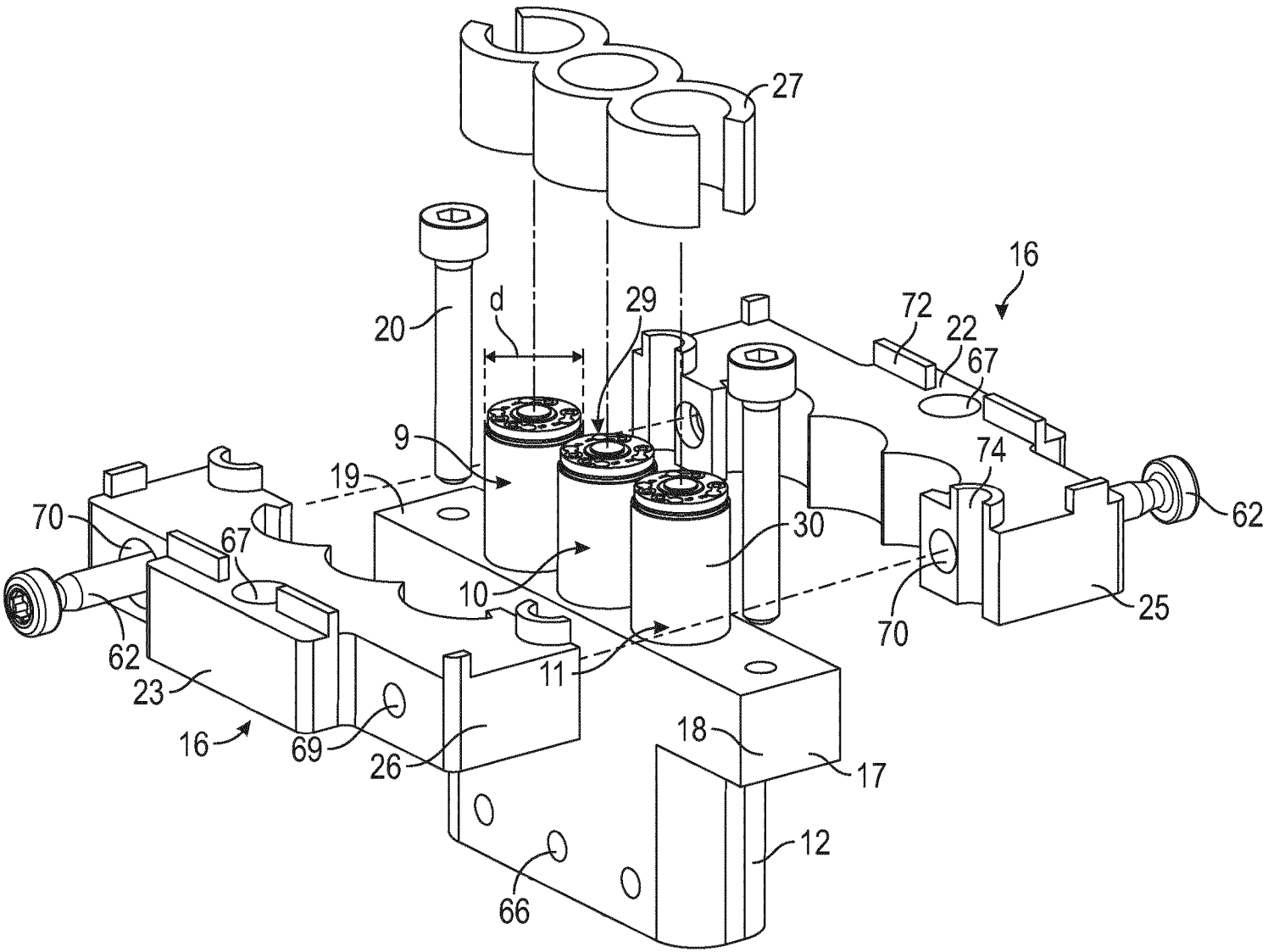
FIG. 7 is a perspective exploded view of some parts of the sand mould identification device of FIG. 1, at a second stage of assembly of the device.
Figure 8:
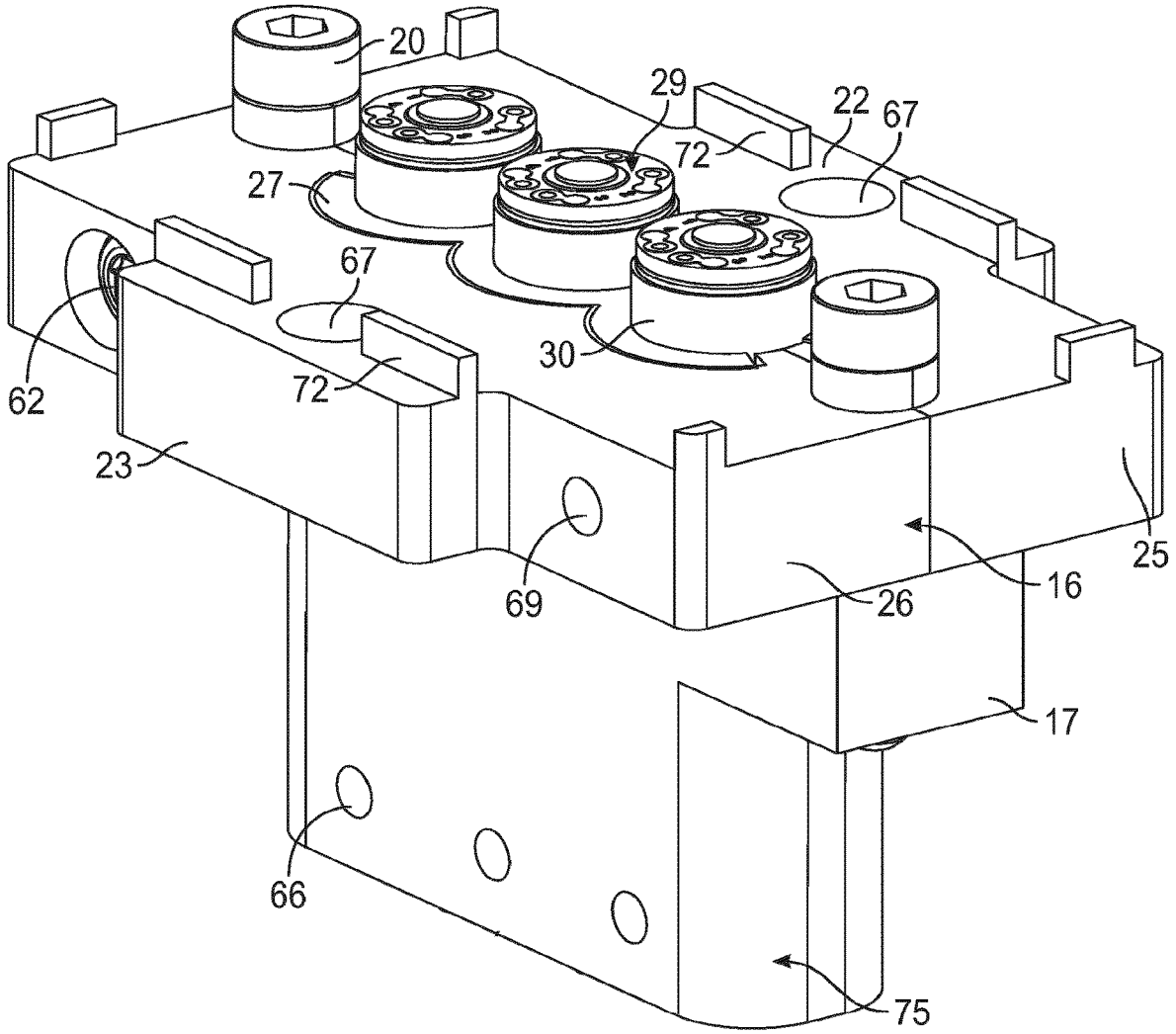
FIG. 8 is a perspective rear view of the partly assembled sand mould identification device of FIG. 1, whereby, however, the printed circuit board and the cover have not yet been mounted, but bolts for holding the printed circuit board and cover have been temporarily mounted.

Comparing FIGS. 1 and 2, it is seen that the insertion portion 12 has a cross-sectional dimension CS transversely to the insertion direction D. The cross-sectional dimension CS is maximum 30 percent, preferably maximum 20 percent, and most preferred maximum 10 percent larger than a diameter d of the part of the actuator 9, 10, 11 inserted into the insertion portion 12. The diameter d of the actuator 9, 10, 11 is indicated in FIG. 7.

As further seen in the figures, the insertion portion 12 forms part of a mounting block 17 forming protrusions 18, 19 extending in opposed directions at and behind the rear end 15 of the insertion portion 12, and the mounting bracket 16 is fastened to the respective protrusions 18, 19 by means of bolts 20.

The three actuators 9, 10, 11 are arranged along a central line 21 of the mounting block 17, indicated in FIG. 2, extending between the opposed protrusions 18, 19 of the mounting block 17. The mounting bracket 16 forms opposed mounting flanges 22, 23 at either side of the central line 21 of the mounting block 17, and the mounting flanges 22, 23 are adapted to be mounted on the sand moulding machine or core shooter by means of bolts 24. Thereby, a slim insertion portion 12 may be achieved resulting in that the sand mould identification device 1 may have a small footprint in the pattern forming surface 4. As it will be understood, thereby the mounting flanges 22, 23 are adapted to be mounted on the rear side of the pattern forming surface 4. The mounting bracket 16 further includes a first bracket part 25 and a second bracket part 26 clamped together and gripping on either side of a part of each actuator 9, 10, 11. By using the mounting bracket 16 as a fixture for the actuators, an even more compact device may be achieved.

An elastic element 27, for instance made of rubber or the like, is sandwiched between the actuators 9, 10, 11 and the first and second bracket parts 25, 26 in order to better secure the actuators in the housing. As seen in FIG. 7, the elastic element 27 has a form composed by three connected tubular parts, of which either outer part is open at the corresponding end of the elastic element 27. When clamped together by means of clamping bolts 62, the first and second bracket parts 25, 26 form an opening corresponding to the outer form of the elastic element 27.

Figure 3:
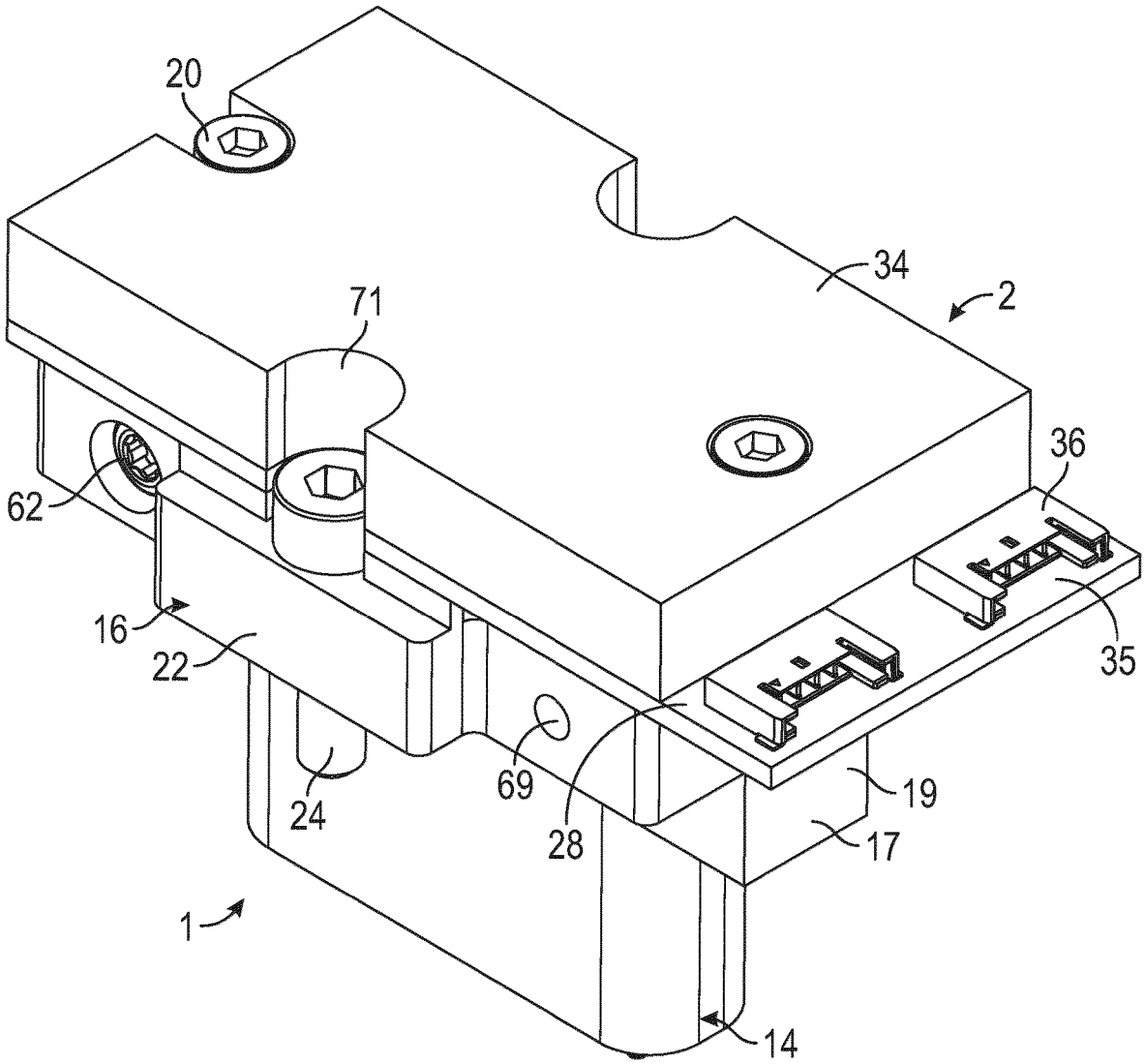
FIG. 3 is a perspective view seen obliquely from a rear side of the sand mould identification device of FIG. 1.
Figure 4:
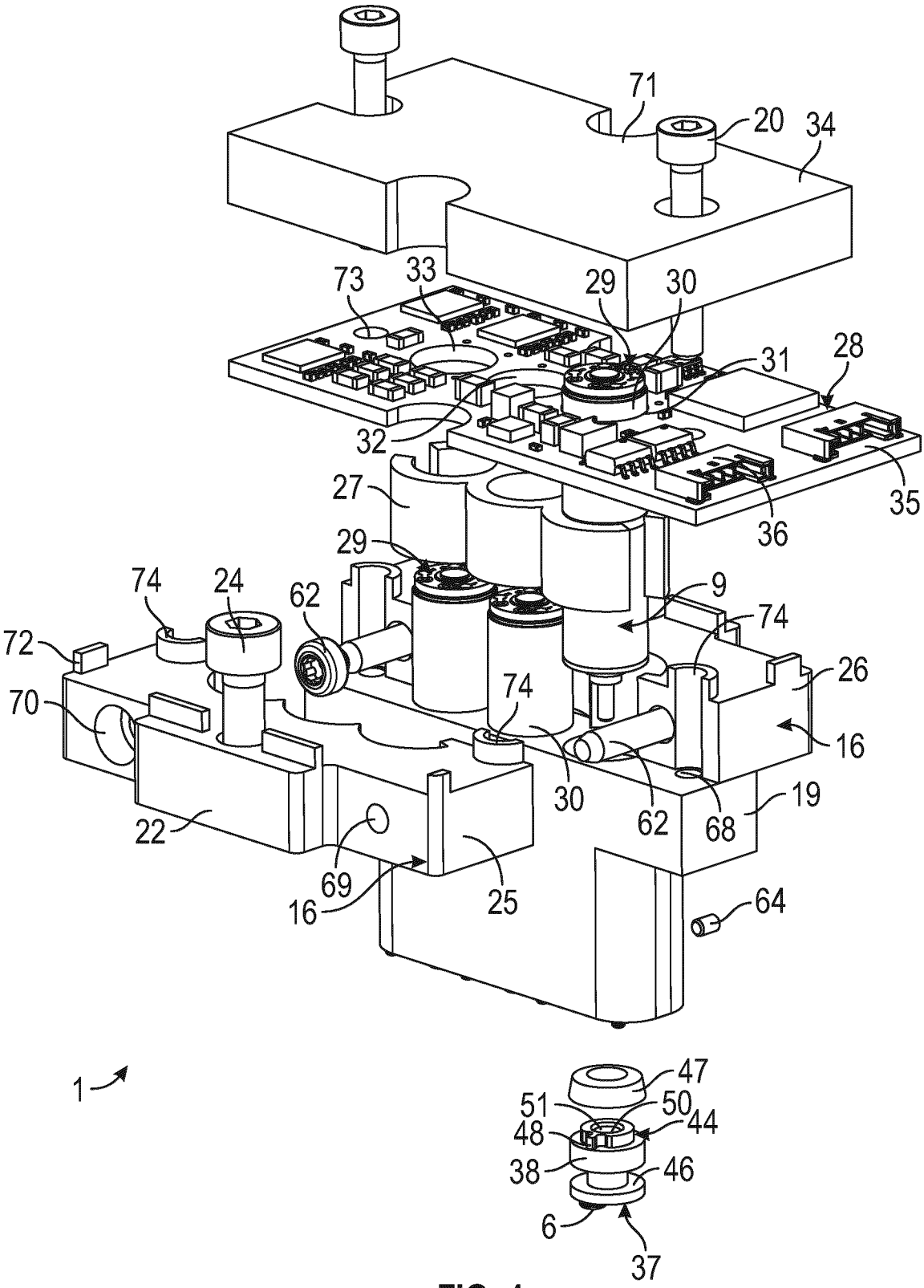
FIG. 4 is a perspective exploded view seen obliquely from the rear side of the sand mould identification device of FIG. 1.

A motor control for the actuators 9, 10, 11 and a network adaptor is arranged behind the rear end 15 of the insertion portion 12 in that a printed circuit board 28 including the motor control and the network adaptor abuts the first and second bracket parts 25, 26 oppositely the insertion portion 12 as seen in FIG. 4. Thereby, the motor control and a network adaptor may be arranged in the housing 2 while the insertion portion 12 may still have a compact configuration. As also illustrated in FIG. 4, a rear end 29 of an electric motor 30 of each actuator 9, 10, 11 extends through a corresponding hole 31, 32, 33 in the printed circuit board 28, whereby an even more compact device may be achieved. The total dimensions of the housing 2 may be very small in relation to the dimensions of the actuators 9, 10, 11. In the assembled state of the sand mould identification device 1, as illustrated in FIG. 3, the printed circuit board 28 is partly covered by a cover 34 so that an edge 35 of the printed circuit board 28 extends from the cover 34 and is provided with at least one network connector part 36. Thereby, the printed circuit board 28 may be covered and at the same time, a compact device may be achieved.

Figure 6:
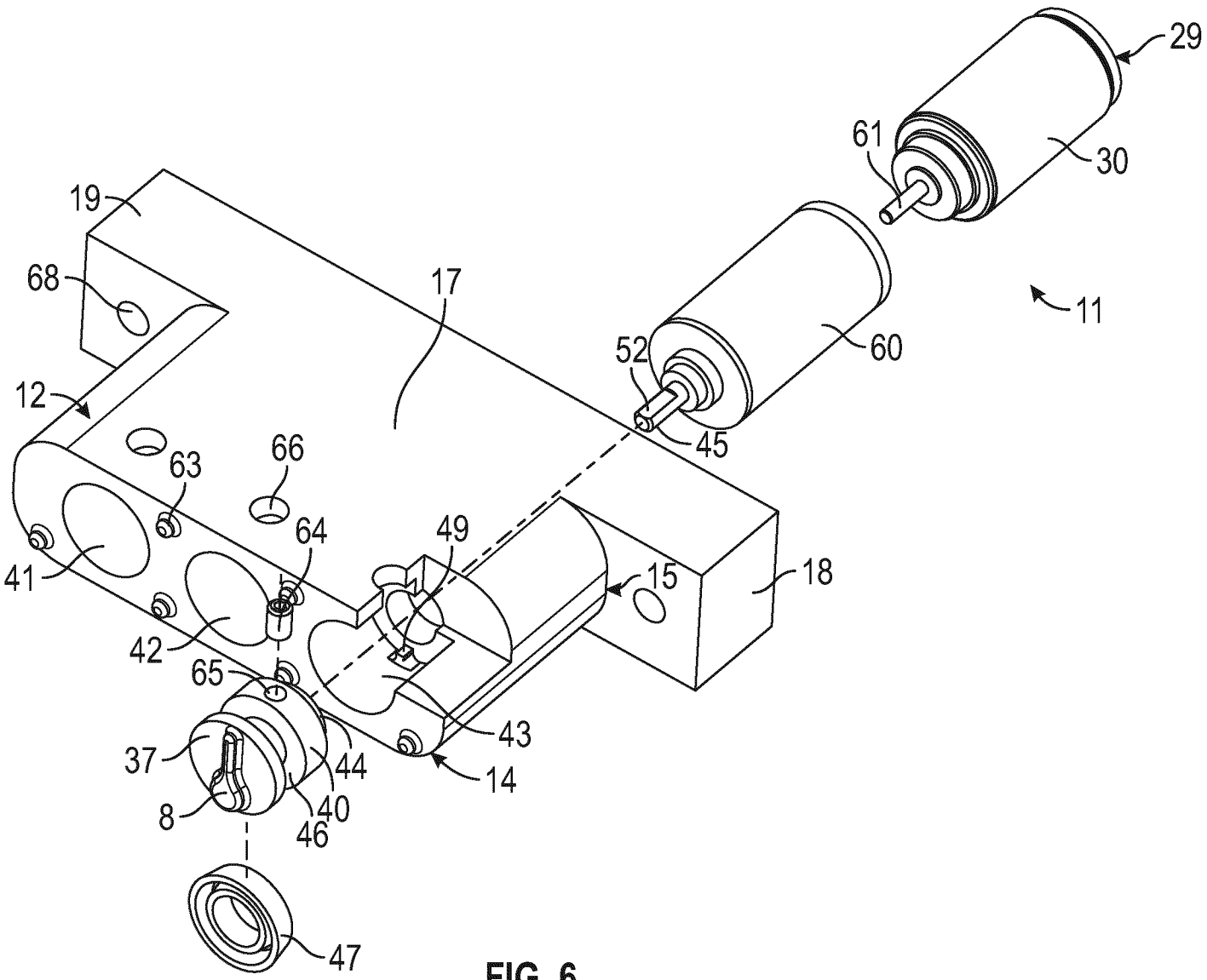
FIG. 6 is a perspective exploded view of some parts of the sand mould identification device of FIG. 1, at a first stage of assembly of the device.

As seen in FIG. 6, each individually adjustable indicator element 6, 7, 8 is arranged at a front end 37 of a cylindrical part 38, 39, 40 fitting in a corresponding bore 41, 42, 43 of the insertion portion 12, wherein a rear end 44 of the cylindrical part 38, 39, 40 engages a shaft end 45 of the corresponding actuator 9, 10, 11. As seen, when assembling the sand mould identification device 1, the cylindrical parts 38, 39, 40 are inserted from the front end 14 of the insertion portion 12 and the actuators 9, 10, 11 are inserted from the rear end 15 of the insertion portion 12. The cylindrical part 38, 39, 40 is provided with a recess 46 in which a sealing ring 47 is arranged. The sealing ring 47 may prevent sand and dust from reaching the internal of the housing 2. Alternatively, the corresponding bore 41, 42, 43 may be provided with the recess 46 for the sealing ring 47. The sealing ring 47 may be a type of piston or rod seal and may for instance be of polyurethane (PUR).

Although in the illustrated embodiment, the three rotationally arranged cylindrical parts 38, 39, 40 are arranged side by side along the line 21 corresponding to the arrangement of the actuators 9, 10, 11, as described above, many other arrangements of the rotationally arranged cylindrical parts 38, 39, 40 are possible. Furthermore, any other suitable number of rotationally arranged cylindrical parts 38, 39, 40 may be arranged in the sand mould identification device 1. For instance, three rotationally arranged cylindrical parts 38, 39, 40 may be arranged in a triangular arrangement, four rotationally arranged cylindrical parts 38, 39, 40 may be arranged in a rectangular or square arrangement or five rotationally arranged cylindrical parts 38, 39, 40 may be arranged in a pentagonal or circular configuration. Likewise, a number of sand mould identification devices 1 may be combined in one pattern forming surface 4 of a pattern plate 56, 79 in order to obtain a suitable number of rotationally arranged cylindrical parts 38, 39, 40 for one pattern forming surface 4.

Each individual indicator element 6, 7, 8 is formed at the front end 37 of the respective cylindrical part 38, 39, 40 arranged rotationally in the housing 2 of the sand mould identification device 1. Each individual indicator element 6, 7, 8 extends in a diametrical direction of the respective cylindrical part 38, 39, 40.

Figure 9:
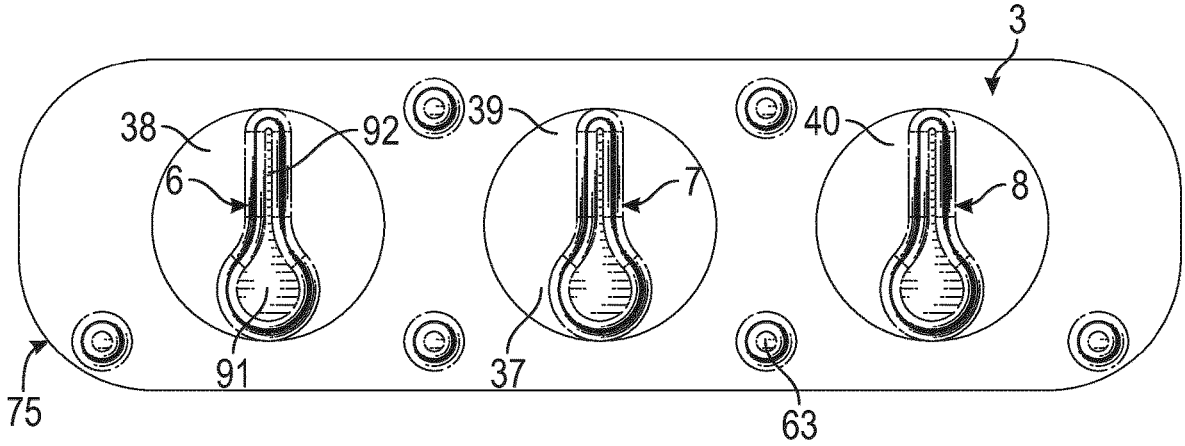
FIG. 9 illustrates part of the sand mould identification device of FIG. 2 on a larger scale.

As seen in FIG. 9, each individually adjustable indicator element 6, 7, 8 is formed with rounded edges and is formed to indicate a direction along a diameter of the corresponding cylindrical part 38, 39, 40 on which it is arranged. Preferably, the individually adjustable indicator element is formed with all its edges being rounded so that no sharp edges are present. Sharp edges may be difficult to mould and may be damaged during a shot blasting process. Furthermore, it is seen that each individually adjustable indicator element 6, 7, 8 is formed to indicate a direction along the diameter of the corresponding cylindrical part in that the individually adjustable indicator element forms a relatively broad, partly circular part 91 at a first end of the diameter of the cylindrical part and a relatively narrow, elongated part 92 at a second end of the diameter of the cylindrical part. The illustrated form of the individually adjustable indicator element may further be said to be more or less drop-like. In other embodiments, the individually adjustable indicator element may be formed to indicate the direction along the diameter of the corresponding cylindrical element in other ways, for instance, the individually adjustable indicator element may taper regularly or irregularly from the first end of said diameter to the second end of said diameter. In other embodiments, the individually adjustable indicator element may have the form of a watch hand, preferably including a kind of arrow-like element.

In an embodiment, each individual indicator element 6, 7, 8 illustrated in FIG. 9 extends at least 0.5 millimetres, preferably at least 0.7 millimetres, and most preferred at least 0.9 millimetres from the corresponding front end 37 of the cylindrical part 38, 39, 40.

It is preferred that each individually adjustable indicator element 6, 7, 8 is formed as a protrusion from the front end of the respective cylindrical part 38, 39, 40 arranged rotationally in the housing 2 of the sand mould identification device 1, as seen in the embodiment illustrated in the figures. However, in an alternative embodiment, each or some of the individually adjustable indicator elements 6, 7, 8 may be formed as a depression in the front end of the respective cylindrical part 38, 39, 40. It is also possible that a first part of an individually adjustable indicator element 6, 7, 8 is formed as a protrusion and a second part of said individually adjustable indicator element is formed as a depression. For instance, the relatively broad, partly circular part 91 at the first end of the diameter of the cylindrical part 38, 39, 40 may be formed as a depression and the relatively narrow, elongated part 92 at the second end of the diameter of the cylindrical part 38, 39, 40 may be formed as a protrusion.

The illustrated embodiment of the individually adjustable indicator element 6, 7, 8 is in particular advantageous in a foundry production line including an automatic image detection system adapted to detect the resulting individual identification patterns in the castings. The automatic image detection system may include an imaging device being adapted to provide a 2D digital image of the individual identification pattern, but an imaging device producing a 3D digital image may also be used. The automatic image detection system may include a computer system adapted to run a computer program developed by means of machine learning to analyse the 2D or 3D digital image and thereby detect the individual identification patterns of the castings. With the illustrated embodiment of the individually adjustable indicator element 6, 7, 8, it may even be possible to detect the individual identification pattern of the castings after a finishing treatment in a finishing apparatus adapted to clean castings, such as by means of blasting, such as shot blasting. Such a foundry production line may also advantageously include a computer controlled database system adapted to store data relating to a number of production variables measured and/or set during production and data relating to the quality of the produced castings.

In the embodiment illustrated in the figures, the identification pattern face 3 of the housing 2 of the sand mould identification device 1 includes six stationary alignment elements 63 adapted to impress an alignment pattern in a sand mould part during its compaction. An automatic image detection system may be adapted to, before detection of an individual identification pattern in a casting, align a 2D or 3D digital image with a reference image of the alignment pattern. Thereby, image detection may be improved in many situations in which it is not possible or not convenient to arrange a casting for image capturing so that the individual identification pattern formed in the casting extends generally at a plane being perpendicular in relation to a camera axis of an imaging device when capturing the 2D or 3D digital image. This may be the case both if the imaging device is arranged in a handheld device or if the imaging device is arranged in a stationary device. As further seen, the three rotationally arranged cylindrical parts 38, 39, 40 are arranged side by side along the line 21, and the six stationary alignment elements 63 are arranged asymmetrically about said line in that four of the stationary alignment elements 63 are arranged along a line below the three rotationally arranged cylindrical parts 38, 39, 40 and two of the stationary alignment elements 63 are arranged along a line above the three rotationally arranged cylindrical parts 38, 39, 40. Of course, many other asymmetrical arrangements of a suitable number of stationary alignment elements 63 are possible. The asymmetrical arrangement of the stationary alignment elements 63 may indicate a reading orientation for the impressions provided by the individually adjustable indicator elements 6, 7, 8 and the possible number of different combinations that may be achieved by the individually adjustable indicator elements may thereby be increased.

Comparing FIGS. 4 and 6, it is seen that a first end stop protrusion 48 is arranged on the cylindrical part 38, 39, 40, and a second corresponding end stop protrusion 49 is arranged in the corresponding bore 41, 42, 43 of the insertion portion 12. Thereby, the motor control may reset the starting position of the actuators 9, 10, 11 when the first and second end stop protrusions 48, 49 abut each other, and consequently a more accurate control of the individually adjustable indicator elements 6, 7, 8 may be achieved. The sealing ring 47 is arranged between the front end 37 of the cylindrical part 38, 39, 40 and the first end stop protrusion 48 arranged on the cylindrical part. Thereby, the sealing ring 47 may also prevent sand and dust from reaching the first and second end stop protrusions 48, 49 and thereby negatively influencing the resetting of the starting position of the actuators 9, 10, 11.

As indicated in FIG. 4, the rear end 44 of the cylindrical part 38, 39, 40 is provided with a partly cylindrical hole 50 having an axially extending flat face 51 corresponding to an axially extending flat face 52 of the shaft end 45 of the corresponding actuator 9, 10, 11 as illustrated in FIG. 6, and the shaft end 45 engages the partly cylindrical hole 50. Thereby, a very precise connection between the rear end 44 of the cylindrical part 38, 39, 40 and the shaft end 45 of the actuator is possible even for very small dimension of the cylindrical part and the shaft end. As seen in FIG. 6, the shaft end 45 of the corresponding actuator 9, 10, 11 is fixed in the partly cylindrical hole 50 of the rear end 44 of the corresponding cylindrical part 38, 39, 40 by means of a set screw 64 which is mounted in a corresponding threaded bore 65 of the rear end 44 of the corresponding cylindrical part 38, 39, 40 so that an end of the set screw 64 abuts the axially extending flat face 52 of the shaft end 45. The corresponding flat faces 51, 52 of the partly cylindrical hole 50 and the shaft end 45, respectively, may ensure that the shaft end 45 is correctly orientated in the partly cylindrical hole 50 so that the set screw 64 may abut the axially extending flat face 52 of the shaft end 45. Otherwise, if the partly cylindrical hole 50 were in fact cylindrical, it could be difficult to position the shaft end 45 correctly in the hole due to the small diameter of the shaft end 45. If the set screw 64 would therefore not correctly engage the flat face 52 of the shaft end 45, the connection between the shaft end and the cylindrical part 38, 39, 40 could be unstable.

As also seen in FIG. 6, a side wall of the insertion portion 12 of the housing 2 is provided with a through hole 66 for each set screw 64 so that the connection between each shaft end 45 and the corresponding cylindrical part 38, 39, 40 may be secured when the cylindrical part 38, 39, 40 has been inserted into the front end 14 of the insertion portion 12 and when a part of the actuator 9, 10, 11 has been inserted into the rear end 15 of the insertion portion 12 so that the shaft end 45 is inserted into the cylindrical part 38, 39, 40.

Figure 16:
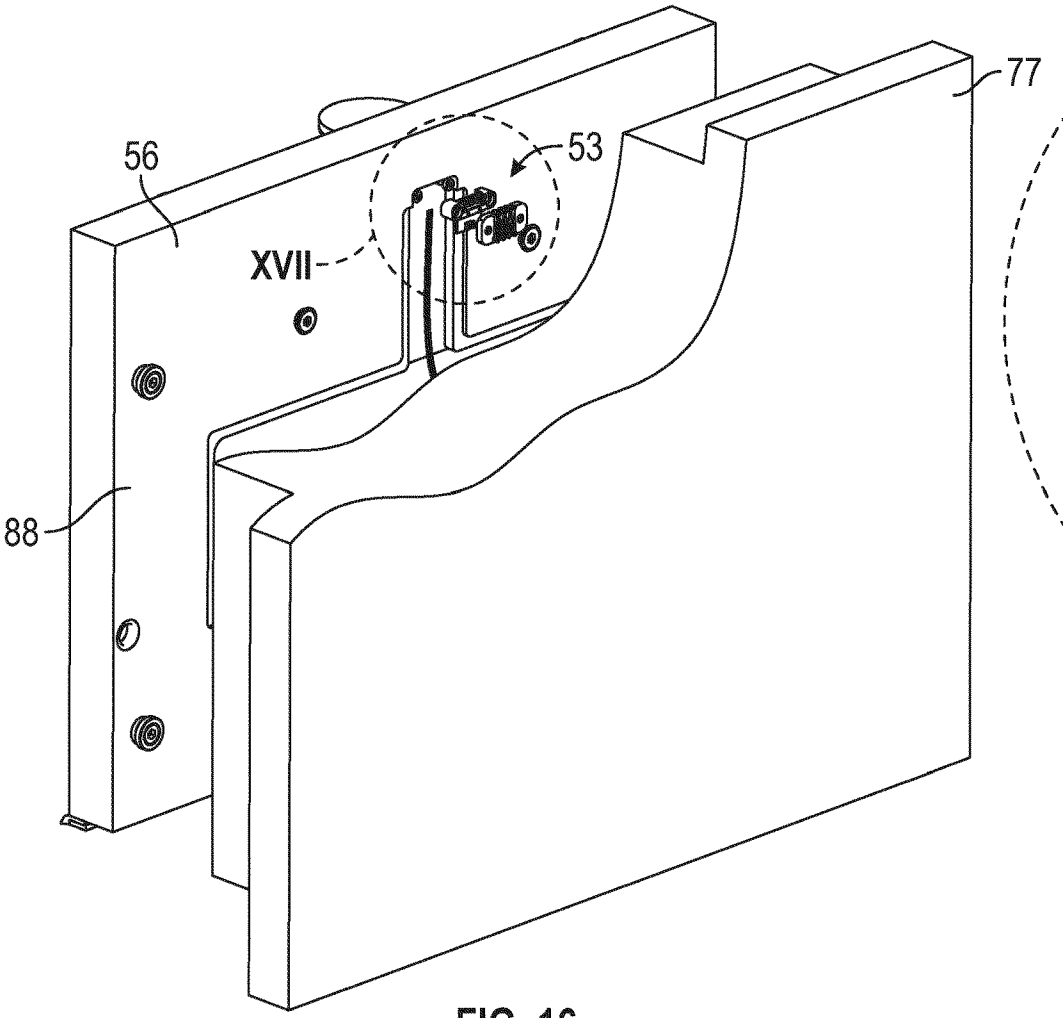
FIG. 16 is a perspective exploded view illustrating part of the back side of the pattern plate of FIG. 13 and part of a heating plate of the vertical sand moulding machine on which the pattern plate is to be mounted.
Figure 18:
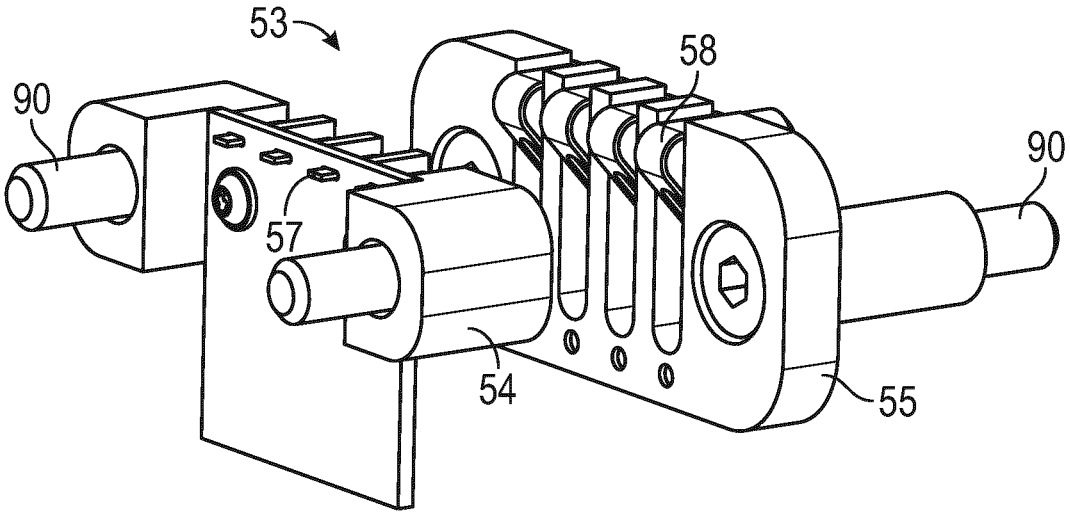
FIG. 18 is a perspective view illustrating a first and a second connector part of the pattern plate and the pressing plate, respectively, of FIG. 13.

As illustrated in FIGS. 11 to 18, the network adaptor of the sand mould identification device 1 is adapted to be connected to a not shown controller of a sand moulding machine 5 by means of a connector 53 including a first connector part 54 adapted to be arranged on a pattern plate 56 of the sand moulding machine and a second connector part 55 adapted to be arranged on the sand moulding machine 5. Each connector part 54, 55 includes a number of electrical contact elements 57, 58, and the electrical contact elements 58 of the second connector part 55 are adapted to flexibly engage and slide on a top side 59 of the respective electrical contact elements 57 of the first connector part 54 during a mounting operation whereby the pattern plate 56 is mounted on the sand moulding machine 5. During the mounting operation, as illustrated in FIG. 16, the pattern plate 56 is brought into engagement with the heating plate 77 and is mounted thereon by means of bolts, whereby the electrical contact elements 58 of the second connector 55 engage the respective electrical contact elements 57 of the first connector part 54 and slide on a top side 59 thereof. Thereby, any sand or dust present on the electrical contact elements 57, 58 will be wiped away and good electrical contact may be established between the electrical contact elements. In this way, a stable network connection may be established between each of the sand mould identification devices 1 and the not shown controller.

In the illustrated embodiment in FIGS. 11 to 17, the pattern plate 56 of the sand moulding machine 5 is provided with two sand mould identification devices 1 connected to the not shown controller of the sand moulding machine by means of a single connector 53 including a first connector part 54 arranged on the pattern plate 56 and a second connector part 55 arranged on the sand moulding machine 5. As seen, depending on the number of castings to be produced in the sand mould, a corresponding number of sand mould identification devices 1 are connected one after the other in a line by means of a network cable 89 which is finally connected to the first connector part 54. Each sand mould identification device 1 includes a printed circuit board 28 as seen in FIG. 1. The second connector part 55 is connected to the not shown controller arranged in the sand moulding machine 5. Thereby, the printed circuit board 28 of each sand mould identification device 1 may communicate with the not shown common controller and be provided with power via the network cable 89 and the connector 53. Of course, alternatively to a network cable, the printed circuit board 28 of each sand mould identification device 1 may communicate with the not shown controller arranged in the sand moulding machine 5 by means of wireless radio communication. In this case, each sand mould identification device 1 may be provided with its own power supply in the form of a battery or the sand mould identification devices 1 may be supplied with power via cable.

As illustrated in FIG. 10, the sand moulding machine 5 includes a moulding chamber 80 in which a first pattern plate 56 arranged on a pressing plate 78 and a second pattern plate 79 arranged on a swing plate 81 are adapted to form respective patterns in either side of a sand mould part during compaction of the sand mould part in the moulding chamber 80. As seen, each of the first pattern plate 56 and the second pattern plate 79 is provided with a pattern forming surface 4. The illustrated sand moulding machine 5 is a vertical flaskless sand moulding machine of the DISAMATIC (registered trade mark) type. The working principle of this type of sand moulding machine is well-known. The moulding chamber 80 is filled with sand through a sand filling opening 84 in a top wall 86 of the moulding chamber 80, and the sand is compacted by displacement of the first and second pattern plates 56, 79 in a direction against each other. Subsequently, the swing plate 81 is displaced and pivoted to an open position in which the sand mould part may leave the moulding chamber in a direction which is directed to the right in FIG. 10. The sand mould part is pressed out of the moulding chamber by displacement of the pressing plate 78 until the sand mould part abuts the previously produced sand mould part on a not shown sand mould conveyor and a sand mould is formed between those two sand mould parts. Thereby, a string of sand moulds is produced.

The first pattern plate 56 of the sand moulding machine 5 illustrated in FIG. 10 is provided with a single sand mould identification device 1 according to the present invention.

The controller is adapted to provide each sand mould formed by two sand mould parts with at least one individual identification pattern arranged to form an individual identification pattern in each resulting casting when the sand mould has been filled with molten metal in a melt pouring device. As understood, each sand mould produced by the sand moulding machine 5 illustrated in FIG. 10 results in one casting provided with a corresponding identification pattern. However, the pattern plate 56 illustrated in FIGS. 11 to 17 is adapted to form two castings, and therefore, the pattern plate 56 is provided with two sand mould identification devices 1 arranged at the respective patterns of the pattern plate 56 so that each casting may be provided with its own identification pattern. In other embodiments, a pattern plate may be adapted to form three or more castings, and the pattern plate may then be provided with a corresponding number of sand mould identification devices 1 arranged at the respective patterns.

Although the illustrated sand moulding machine 5 is a vertical flaskless sand moulding machine, the sand mould identification device 1 according to the present invention is equally applicable to other types of sand moulding machines, such as a sand moulding machine of the match plate type. In a sand moulding machine of the match plate type, the sand moulding machine includes two moulding chambers separated by means of a match plate. On either side of the match plate, a pattern plate is formed and is adapted to form a corresponding pattern in the corresponding sand mould part during compaction of the sand mould part in the respective moulding chamber. In a sand moulding machine of the match plate type, at least one of the pattern plates formed on the match plate is provided with at least one sand mould identification device 1 according to the present invention. Thereby, each sand mould formed by two sand mould parts may be provided with at least one individual identification pattern, according to the number of castings to be formed in the sand mould.

As a further example, the sand mould identification device 1 according to the present invention is equally applicable to a horizontal flask line in which cope and drag are combined to form a flask. Each of the cope and drag is provided with a pattern plate. In a sand moulding machine in a horizontal flask line, at least one of the two pattern plates may be provided with at least one sand mould identification device 1 according to the present invention. Thereby, each sand mould formed in a flask composed by cope and drag may be provided with at least one individual identification pattern, according to the number of castings formed in the sand mould.

The motor control arranged on the printed circuit board 28 is adapted to control the actuator 9, 10, 11 corresponding to each individual indicator element 6, 7, 8 so that the individual indicator element may be positioned in at least 15, preferably at least 20, more preferred at least 30, and most preferred at least 35 different rotational positions about the axis of rotation of the cylindrical part 38, 39, 40. Advantageously, the motor control may be adapted to control the actuator corresponding to each individual indicator element 6, 7, 8 so that the individual indicator element may be positioned in about 40 different rotational positions. The motor control may be adapted to control the actuator corresponding to each individual indicator element 6, 7, 8 so that the rotational position of the individual indicator element about the axis of rotation of the corresponding cylindrical part is adjusted in increments of less than 20 degrees, preferably of less than 15 degrees, and most preferred of less than 10 degrees.

Purely as an example, the first end stop protrusion 48 of the cylindrical part 38, 39, 40 and the second end stop protrusion 49 of the bore 41, 42, 43 may together take up about 30 degrees of the total possible rotation of the cylindrical part 38, 39, 40 in the corresponding bore 41, 42, 43 of the insertion portion 12. In this case, the actual possible rotation of the cylindrical part from a first rotational end position to a second rotational end position will be about 330 degrees. In the illustrated embodiment, at the first rotational end position, a first side of the first end stop protrusion 48 of the cylindrical part 38, 39, 40 abuts the second end stop protrusion 49 of the bore 41, 42, 43 on a first side thereof, and at the second rotational end position, a second side of the first end stop protrusion 48 of the cylindrical part 38, 39, 40 abuts the second end stop protrusion 49 of the bore 41, 42, 43 on a second side thereof. Thereby both end positions can be detected, and bigger precision can be achieved, furthermore self-diagnostics can be performed.

The electric motor 30 of each actuator 9, 10, 11 is preferably a stepper motor, preferably driven by microstepping the stepper motor. The transmission provided for the electric motor 30 is preferably a planetary gear 60, but other types of transmission are possible, including no gear. As illustrated in FIG. 6, a shaft end 61 of the electric motor 30 is connected with a not visible input drive end of the planetary gear 60. The electric motor 30 and the planetary gear 60 are thereby combined into a common unit forming the actuator 9, 10, 11 and the output shaft end 45 of the planetary gear 60 thereby forms the output shaft of the actuator.

Each actuator 9, 10, 11 may be provided with a rotary encoder in order to control the rotational position of the respective cylindrical parts 38, 39, 40. However, it is preferred to use a stepper motor and corresponding motor controller which may detect lost or gained steps and measure motor load and which may use these parameters for self-test diagnostics. A homing function may be made against the first and/or second end stop protrusions 48, 49 in order to initialise the position of the cylindrical part 38, 39, 40. The homing function may employ programmable current control. Thereby, inaccuracies as a result of backlash in the transmission from motor to cylindrical part may be reduced or eliminated.

A not shown computer controlled database system may be adapted to store each of such distinctive rotational positions of the individual indicator element 6, 7, 8 as belonging to a corresponding distinctive individual identification pattern to be formed in a casting.

The mounting block 17 including the insertion portion 12, the cylindrical parts 38, 39, 40 with the corresponding individually adjustable indicator elements 6, 7, 8 and the mounting bracket 16 may advantageously be produced for instance by micro milling or micro printing. The parts may advantageously be made of metal.

The following embodiments are disclosed:

1. A sand mould identification device 1 with a housing 2 including an identification pattern face 3 adapted to be arranged in a pattern forming surface 4 of a sand moulding machine 5 or a core shooter, wherein a plurality of individually adjustable indicator elements 6, 7, 8 are arranged rotationally in the identification pattern face 3, the rotational position of each individual indicator element being 6, 7, 8 adjustable by means of an actuator 9, 10, 11, wherein the housing 2 includes an insertion portion 12 adapted to be inserted into a corresponding recess 13 of said sand moulding machine 5 or core shooter and having a front end 14 and a rear end 15, wherein the identification pattern face 3 is located at the front end 14 of the insertion portion 12, wherein at least a part of each actuator 9, 10, 11 is inserted into the insertion portion 12, and wherein the housing 2 includes a mounting device for mounting the housing 2 to the sand moulding machine 5 or core shooter, characterised in that, in the assembled state of the sand mould identification device 1, the insertion portion 12 is adapted to be inserted into the sand moulding machine 5 or core shooter in an insertion direction D extending from the rear end 15 to the front end 14 of the insertion portion 12, and in that the mounting device is accessible at or behind the rear end 15 of the insertion portion 12 for mounting or demounting the housing 2 to or from the sand moulding machine 5 or core shooter.

2. A sand mould identification device according to embodiment 1, wherein a motor control for the actuators 9, 10, 11 and a network adaptor is arranged behind the rear end 15 of the insertion portion 12.

3. A sand mould identification device according to embodiment 1 or 2, wherein the mounting device has the form of a mounting bracket 16 arranged at or behind the rear end 15 of the insertion portion 12 and protruding in relation to the insertion portion 12 in a direction being transverse to the insertion direction D.

4. A sand mould identification device according to embodiment 3, wherein the insertion portion 12 forms part of a mounting block 17 forming protrusions 18, 19 extending in opposed directions at the rear end 15 of the insertion portion 12, and wherein the mounting bracket 16 is fastened to the respective protrusions 18, 19 preferably by means of bolts 20.

5. A sand mould identification device according to embodiment 4, wherein the actuators 9, 10, 11 are arranged along a central line 21 of the mounting block 17 extending between the opposed protrusions 18, 19 of the mounting block 17, wherein the mounting bracket 16 forms opposed mounting flanges 22, 23 at either side of the central line 21 of the mounting block 17, and wherein the mounting flanges 22, 23 are adapted to be mounted on the sand moulding machine 5 or core shooter preferably by means of bolts 24.

6. A sand mould identification device according to any one of the embodiments 3 to 5, wherein the mounting bracket 16 includes a first bracket part 25 and a second bracket part 26 clamped together and gripping on either side of a part of each actuator 9, 10, 11.

7. A sand mould identification device according to embodiment 6, wherein an elastic element 27 is sandwiched between the actuators 9, 10, 11 and the first and second bracket parts 25, 26.

8. A sand mould identification device according to embodiment 6 or 7, wherein a printed circuit board 28 including a motor control and a network adaptor abuts the first and second bracket parts 25, 26 oppositely the insertion portion 12.

9. A sand mould identification device according to embodiment 8, wherein a rear end 29 of an electric motor 30 of each actuator 9, 10, 11 extends through a hole 31, 32, 33 in the printed circuit board 28.

10. A sand mould identification device according to embodiment 8 or 9, wherein the printed circuit board 28 is partly covered by a cover 34 so that an edge 35 of the printed circuit board 28 extends from the cover 34 and is provided with at least one network connector part 36.

11. A sand mould identification device according to any one of the preceding embodiments, wherein each individually adjustable indicator element 6, 7, 8 is arranged at a front end 37 of a cylindrical part 38, 39, 40 fitting in a corresponding bore 41, 42, 43 of the insertion portion 12, wherein a rear end 44 of the cylindrical part 38, 39, 40 engages a shaft end 45 of the corresponding actuator 9, 10, 11, and wherein the cylindrical part 38, 39, 40 and/or the corresponding bore 41, 42, 43 has a recess 46 in which a sealing ring 47 is arranged.

12. A sand mould identification device according to embodiment 11, wherein a first end stop protrusion 48 is arranged on the cylindrical part 38, 39, 40, and a second corresponding end stop protrusion 49 is arranged in the corresponding bore 41, 42, 43 of the insertion portion 12.

13. A sand mould identification device according to embodiment 12, wherein the sealing ring 47 is arranged between the front end 37 of the cylindrical part 38, 39, and the first end stop protrusion 48 arranged on the cylindrical part.

14. A sand mould identification device according to any one of the embodiments 11 to 13, wherein the rear end 44 of the cylindrical part 38, 39, 40 is provided with a partly cylindrical hole 50 having an axially extending flat face 51 corresponding to an axially extending flat face 52 of the shaft end 45 of the corresponding actuator 9, 10, 11, and wherein said shaft end 45 engages the partly cylindrical hole 50.

15. A sand mould identification device according to any one of the embodiments 2 to 14, wherein the network adaptor of the sand mould identification device 1 is adapted to be connected to a controller of a sand moulding machine 5 by means of a connector 53 including a first connector part 54 adapted to be arranged on a pattern plate 56 of the sand moulding machine 5 and a second connector part 55 adapted to be arranged on the sand moulding machine 5, wherein each connector part 54, 55 includes a number of electrical contact elements 57, 58, and wherein the electrical contact elements 58 of the second connector part 55 are adapted to flexibly engage and slide on a top side 59 of the respective electrical contact elements 57 of the first connector part 54 during a mounting operation of the pattern plate 56 on the sand moulding machine 5.

16. A sand mould identification device according to any one of the preceding embodiments, wherein the insertion portion 12 has a cross-sectional dimension CS transversely to the insertion direction D being maximum 30 percent, preferably maximum 20 percent, and most preferred maximum 10 percent larger than a diameter d of the part of the actuator 9, 10, 11 inserted into the insertion portion 12.

17. A sand moulding machine including at least one sand mould identification device 1 according to any one of the preceding embodiments.

LIST OF REFERENCE NUMBERS

CS cross-sectional dimension of insertion portion
d diameter of part of actuator inserted into insertion portion
D insertion direction of insertion portion
1 sand mould identification device
2 housing
3 identification pattern face of housing
4 pattern forming surface of sand moulding machine or core shooter
5 sand moulding machine
6, 7, 8 individually adjustable indicator element
9, 10, 11 actuator
12 insertion portion of housing
13 recess of sand moulding machine or core shooter
14 front end of insertion portion
15 rear end of insertion portion
16 mounting bracket
17 mounting block
18, 19 protrusion of mounting block
20 bolt for assembly of housing parts
21 central line of mounting block
22, 23 mounting flange of mounting bracket
24 mounting bolt for mounting flange
25 first bracket part
26 second bracket part
27 elastic element
28 printed circuit board
29 rear end of electric motor
30 electric motor of actuator
31, 32, 33 hole in printed circuit board
34 cover
35 edge of printed circuit board
36 network connector part
37 front end of cylindrical part
38, 39, 40 cylindrical part
41, 42, 43 bore of insertion portion
44 rear end of cylindrical part
45 shaft end of planetary gear of actuator
46 recess of cylindrical part or bore
47 sealing ring
48 first end stop protrusion of cylindrical part
49 second end stop protrusion of bore
50 partly cylindrical hole of rear end of cylindrical part
51 axially extending flat face of partly cylindrical hole
52 axially extending flat face of shaft end of actuator
53 connector
54 first connector part
55 second connector part
56 first pattern plate
57 electrical contact elements of first connector part
58 electrical contact elements of second connector part
59 top side of electrical contact element of first connector part
60 planetary gear of actuator
61 shaft end of electrical motor of actuator
62 clamping bolt for first and second bracket parts
63 stationary alignment element
64 set screw for cylindrical part
65 threaded bore for set screw
66 through hole for set screw
67 bore for mounting bolt
68 threaded bore for assembly bolt
69 threaded bore for clamping bolt
70 bore for clamping bolt
71 recess in cover for mounting bolt
72 protruding spacer on mounting bracket for printed circuit board
73 hole in printed circuit board for assembly bolt
74 bore in mounting bracket for assembly bolt
75 rounded part of insertion portion
76 piston for pressing plate
77 heating plate of sand moulding machine
78 pressing plate of sand moulding machine
79 second pattern plate
80 moulding chamber of sand moulding machine
81 swing plate of sand moulding machine
82 pivot axis for swing plate
83 swing arm for swing plate
84 sand filling opening in top wall of moulding chamber
85 bottom wall of moulding chamber
86 top wall of moulding chamber
87 front side of pattern plate
88 back side of pattern plate
89 network cable

90 mounting bolt for connector part

91 relatively broad, partly circular part of individually adjustable indicator element

92 relatively narrow, elongated part of individually adjustable indicator element

The invention claimed is:

1. A sand mould identification device with a housing including an identification pattern face adapted to be arranged in a pattern forming surface of a sand moulding machine or a core shooter, wherein a plurality of individually adjustable indicator elements are arranged rotationally in the identification pattern face, the rotational position of each individual indicator element being adjustable by means of an actuator, wherein the housing includes an insertion portion adapted to be inserted into a corresponding recess of said sand moulding machine or core shooter and having a front end and a rear end, wherein the identification pattern face is located at the front end of the insertion portion, wherein at least a part of the actuator is inserted into the insertion portion, and wherein the housing includes a mounting device for mounting the housing to the sand moulding machine or core shooter, wherein, in an assembled state of the sand mould identification device, the insertion portion is adapted to be inserted into the sand moulding machine or core shooter in an insertion direction extending from the rear end to the front end of the insertion portion, in that the mounting device is accessible at or behind the rear end of the insertion portion for mounting or demounting the housing to or from the sand moulding machine or core shooter, and in that the mounting device has the form of a mounting bracket arranged at or behind the rear end of the insertion portion and protruding in relation to the insertion portion in a direction being transverse to the insertion direction.

2. A sand mould identification device according to claim 1, wherein a motor control for the actuator and a network adaptor is arranged behind the rear end of the insertion portion.

3. A sand mould identification device according to claim 2, wherein the network adaptor of the sand mould identification device is adapted to be connected to a controller of a sand moulding machine by means of a connector including a first connector part adapted to be arranged on a pattern plate of the sand moulding machine and a second connector part adapted to be arranged on the sand moulding machine, wherein each connector part includes a number of electrical contact elements, and wherein the electrical contact elements of the second connector part are adapted to flexibly engage and slide on a top side of the respective electrical contact elements of the first connector part during a mounting operation of the pattern plate on the sand moulding machine.

4. A sand mould identification device according to claim 2, wherein the insertion portion forms part of a mounting block forming protrusions extending in opposed directions at the rear end of the insertion portion, and wherein the mounting bracket is fastened to the respective protrusions.

5. A sand mould identification device according to claim 2, wherein the mounting bracket includes a first bracket part and a second bracket part clamped together and gripping on either side of a part of the actuator.

6. A sand mould identification device according to claim 1, wherein the insertion portion forms part of a mounting block forming protrusions extending in opposed directions at the rear end of the insertion portion, and wherein the mounting bracket is fastened to the respective protrusions.

7. A sand mould identification device according to claim 6, wherein the actuator is one of a plurality of actuators arranged along a central line of the mounting block extending between the opposed protrusions of the mounting block, wherein the mounting bracket forms opposed mounting flanges at either side of the central line of the mounting block, and wherein the mounting flanges are adapted to be mounted on the sand moulding machine or core shooter.

8. A sand mould identification device according to claim 7, wherein the mounting bracket includes a first bracket part and a second bracket part clamped together and gripping on either side of a part of each actuator.

9. A sand mould identification device according to claim 6, wherein the mounting bracket includes a first bracket part and a second bracket part clamped together and gripping on either side of a part of the actuator.

10. A sand mould identification device according to claim 1, wherein the mounting bracket includes a first bracket part and a second bracket part clamped together and gripping on either side of a part of the actuator.

11. A sand mould identification device according to claim 10, wherein an elastic element is sandwiched between the actuator and the first and second bracket parts.

12. A sand mould identification device according to claim 10, wherein a printed circuit board including a motor control and a network adaptor abuts the first and second bracket parts oppositely the insertion portion.

13. A sand mould identification device according to claim 12, wherein a rear end of an electric motor of the actuator extends through a hole in the printed circuit board.

14. A sand mould identification device according to claim 12, wherein the printed circuit board is partly covered by a cover so that an edge of the printed circuit board extends from the cover and is provided with at least one network connector part.

15. A sand mould identification device according to claim 1, wherein the actuator is one of a plurality of actuators corresponding to the plurality of individually adjustable indicator elements, respectively, wherein each individually adjustable indicator element is arranged at a front end of a cylindrical part fitting in a corresponding bore of the insertion portion, wherein a rear end of the cylindrical part engages a shaft end of the corresponding actuator, and wherein the cylindrical part and/or the corresponding bore has a recess in which a sealing ring is arranged.

16. A sand mould identification device according to claim 15, wherein a first end stop protrusion is arranged on the cylindrical part, and a second corresponding end stop protrusion is arranged in the corresponding bore of the insertion portion.

17. A sand mould identification device according to claim 16, wherein the sealing ring is arranged between the front end of the cylindrical part and the first end stop protrusion arranged on the cylindrical part.

18. A sand mould identification device according to claim 15, wherein the rear end of the cylindrical part is provided with a partly cylindrical hole having an axially extending flat face corresponding to an axially extending flat face of the shaft end of the corresponding actuator, and wherein said shaft end engages the partly cylindrical hole.

19. A sand mould identification device according to claim 1, wherein the insertion portion has a cross-sectional dimension transversely to the insertion direction being maximum 30 percent larger than a diameter of the at least a part of the actuator inserted into the insertion portion.

20. A sand moulding machine including at least one sand mould identification device according to claim 1.

* * * * *